US012654054B2

(12) United States Patent
Vavra

(10) Patent No.: US 12,654,054 B2
(45) Date of Patent: Jun. 16, 2026

(54) ARCUATE WEIGHTLIFTING WEIGHT APPARATUSES AND METHODS OF USING THE SAME

(71) Applicant: Stephen Vavra, Huntley, IL (US)

(72) Inventor: Stephen Vavra, Huntley, IL (US)

( * ) Notice: Subject to any disclaimer, the term of this patent is extended or adjusted under 35 U.S.C. 154(b) by 60 days.

(21) Appl. No.: 18/384,674

(22) Filed: Oct. 27, 2023

(65) Prior Publication Data

US 2024/0149097 A1 May 9, 2024

Related U.S. Application Data

(60) Provisional application No. 63/423,116, filed on Nov. 7, 2022.

(51) Int. Cl.

| | |
|---|---|
| ***A63B 21/06*** | (2006.01) |
| ***A63B 21/00*** | (2006.01) |
| ***A63B 21/065*** | (2006.01) |
| ***A63B 21/072*** | (2006.01) |
| ***A63B 71/00*** | (2006.01) |

(52) U.S. Cl.

CPC ..... *A63B 21/0604* (2013.01); *A63B 21/065* (2013.01); *A63B 21/0728* (2013.01); *A63B 21/4035* (2015.10); *A63B 71/0054* (2013.01)

(58) Field of Classification Search

CPC . A63B 21/0604; A63B 21/065; A63B 21/072; A63B 21/0724; A63B 21/0728; A63B 21/4035; A63B 71/0054; A63B 2209/00

See application file for complete search history.

(56) References Cited

U.S. PATENT DOCUMENTS

| | | | | | |
|---|---|---|---|---|---|
| 3,322,425 | A * | 5/1967 | Moore | A63B 21/4001 | 482/105 |
| 4,351,526 | A * | 9/1982 | Schwartz | A63B 21/4019 | 482/108 |
| 4,429,870 | A | 2/1984 | Gibbs | | |
| 4,605,222 | A | 8/1986 | Shannon | | |
| 4,627,618 | A * | 12/1986 | Schwartz | A63B 21/072 | 482/108 |
| 4,768,780 | A * | 9/1988 | Hayes | A63B 21/0724 | 482/106 |
| 5,033,740 | A * | 7/1991 | Schwartz | A63B 21/0722 | 482/106 |

(Continued)

FOREIGN PATENT DOCUMENTS

| | | |
|---|---|---|
| DE | 1928111 | 7/1970 |
| DE | 10237083 | 9/2003 |
| WO | 2015056951 | 10/2014 |

*Primary Examiner* — Joshua Lee

(74) *Attorney, Agent, or Firm* — Scherrer Patent & Trademark Law, P.C.; Stephen T. Scherrer; Monique A. Morneault

(57) ABSTRACT

Arcuate weightlifting weight apparatuses allow a user to easily grip the same for a series of exercises. The arcuate weightlifting weight apparatuses provide gripping sections for holding the same with hands, feet for placing on a floor and positioning in a vertical plane, and a neck or head pad for using the arcuate weightlifting weight on a user's neck or head with comfort. Moreover, the arcuate weightlifting weight apparatuses optionally include an aperture for placing on a weightlifting bar. Methods of using the same are further provided.

21 Claims, 9 Drawing Sheets

(56) References Cited

U.S. PATENT DOCUMENTS 5,135,455 A * 8/1992 King ..... A63B 21/0726 482/108
5,221,244 A * 6/1993 Doss ..... A63B 21/075 482/106
5,242,350 A * 9/1993 Chang ..... A63B 21/075 482/93
D352,981 S * 11/1994 Ko ..... D21/682
D384,713 S * 10/1997 Eckmann ..... D21/682
5,725,461 A * 3/1998 Bogard, II ..... A63B 21/072 482/106
5,823,922 A * 10/1998 Eckmann ..... A63B 21/4035 482/44
6,436,016 B1 8/2002 Valentino
7,261,677 B2 8/2007 Aahman
7,458,921 B2 * 12/2008 Hallar ..... A63B 21/0726 482/106
7,585,260 B2 * 9/2009 Ma ..... A63B 21/4035 482/106
8,241,189 B2 8/2012 Kanaoka
9,005,087 B1 4/2015 Betoney, Jr.
D731,010 S 6/2015 Levitt et al.
9,452,518 B2 * 9/2016 Perry ..... B25G 1/10
D774,605 S 12/2016 Summers
10,029,139 B2 7/2018 Miklosi et al.
10,478,658 B2 11/2019 Polenz
10,881,893 B2 * 1/2021 Welde ..... A63B 21/0724
D940,257 S 1/2022 Kravchenko
11,241,601 B2 * 2/2022 Sorin ..... A63B 21/0728
D1,038,291 S * 8/2024 Barata ..... D21/675
2006/0040802 A1 * 2/2006 Vittone ..... A63B 23/1263 482/106
2013/0040790 A1 2/2013 Morris
2014/0005013 A1 * 1/2014 Kassemi ..... A63B 21/4035 482/108
2015/0367172 A1 12/2015 Levitt et al.
2017/0095687 A1 4/2017 Sonnon et al.

* cited by examiner

Push-ups

Push-ups

Lying Neck Curls

Lying Neck Curls

Bench Press

Bench Press

One-Arm Rows

One-Arm Rows

Dips

Dips

Seated Calf Raises

Seated Calf Raises

Squats

Squats

Reverse Curls

Reverse Curls

ARCUATE WEIGHTLIFTING WEIGHT APPARATUSES AND METHODS OF USING THE SAME

CROSS-REFERENCE TO RELATED APPLICATIONS

The present invention claims priority to U.S. Provisional Patent App. No. 63/423,116, titled "Arcuate Weightlifting Weight Apparatuses and Methods of Using the Same," filed Nov. 7, 2022, which is incorporated herein by reference in its entirety.

TECHNICAL FIELD

The present invention relates to arcuate weightlifting weight apparatuses allowing a user to easily grip the same for a series of exercises. The arcuate weightlifting weight apparatuses provide gripping sections for holding the same with hands, base feet for placing on a floor and positioning in a vertical plane, and a neck or head pad for using the arcuate weightlifting weight on a user's neck or head with comfort. Moreover, the arcuate weightlifting weight apparatuses optionally include an aperture for placing on a weightlifting bar. Methods of using the same are further provided.

BACKGROUND

Many different types of weightlifting or exercise weights are known. These typically include dumb-bells, bar bells, weighted balls (also known as "medicine balls"), weight plates or other like weightlifting shapes. Many of these weights are precisely metered to have a specific weight so that a user knows how much he or she is lifting during an exercise. Many of these weightlifting or exercise plates are utilized by directly manipulating the same in repetitive exercises using hands or other body parts. In other cases, weightlifting plates have apertures in the centers thereof for placement onto weightlifting bars for conducting repetitive exercises using the bar with the plates thereon.

Many weightlifting plates are difficult to manipulate. Specifically, dumb-bells or bar bells have specific shapes, namely two spherical or similarly shaped lobes that are connected with a bridging grip bar that is disposed between the two lobes. These types of weightlifting weights are used for one purpose—for a user to grip the same by the bridging grip bar with his or her hands and fingers.

Weighted balls are also used for repetitive exercises to build muscle and for conditioning purposes. Specifically, the weighted balls are spherical having precisely metered weights so that the user can know how much he or she is using in the repetitive exercises. Typically, the weight balls have a soft, grippable outer grip layer that allows a user to spread his or her hands out to grip the same and use for the exercises. In other cases, the balls may be held between the feet or legs and used for exercises.

Weightlifters and exercisers may wish to do repetitive weightlifting exercises in a manner that is difficult to do with the weights on-hand. Specifically, some users utilized weightlifting plates in ways other than placement on a weightlifting bar. For example, a user may wish to grip a weightlifting plate in his or her hand and do a repetitive exercise, such as an arm curl or triceps extension. To do so, he or she must grip the plate on its end. However, weightlifting plates do not have specific gripping elements that easily allow a user to grip the same to use with the desired repetitive exercise.

Moreover, some exercises are useful by putting a weight on the user's head or, more specifically, on the user's neck. However, weightlifting weights are typically not shaped to fit on a user's head or neck. Often, the weights are made of metal so that placement on the head or neck is often uncomfortable. And because weights are typically not shaped for placement on the head or neck, they may be difficult to manipulate or control when in use for repetitive exercises.

A need, therefore, exists for improved weightlifting weight apparatuses. Specifically, a need exists for improved weightlifting weight apparatuses that are easy to grip and manipulate by a user. More specifically, a need exists for improved weightlifting weight apparatuses that allow a user to utilize the same easily for repetitive exercises.

Moreover, a need exists for improved weightlifting weight apparatuses that may more easily be utilized for both manual manipulation of the same and on weightlifting bars. Specifically, a need exists for improved weightlifting weight apparatuses having manual hand grips and an aperture for disposing on a weightlifting bar. Moreover, a need exists for improved weightlifting weight apparatuses that are precisely metered and have a variety of weights for use thereof by a user. In addition, a need exists for improved weightlifting weight apparatuses that may easily be utilized on a user's head or neck.

SUMMARY OF THE INVENTION

The present invention relates to arcuate weightlifting weight apparatuses allowing a user to easily grip the same for a series of exercises. The arcuate weightlifting weight apparatuses provide gripping sections for holding the same with hands, base feet for placing on a floor and positioning in a vertical plane, and a neck or head pad for using the arcuate weightlifting weight on a user's neck or head with comfort. Moreover, the arcuate weightlifting weight apparatuses optionally include an aperture for placing on a weightlifting bar. Methods of using the same are further provided.

To this end, in an embodiment of the present invention, an arcuate weightlifting weight apparatus is provided. The arcuate weightlifting weight apparatus comprises a first flat base, a second flat base, a first arcuate bridging member extending between the first flat base and the second flat base, a second arcuate bridging member extending between the first flat base and the second flat base, at least one reinforcement element extending between the first arcuate bridging member and the second arcuate bridging member connecting the first arcuate bridging member to the second arcuate bridging member, and a pad on an exposed surface of the first bridging member.

In an embodiment, the first flat base and the second flat base are feet that are configured to hold the first and second bridging members in a vertical plane when placed upon a floor.

It is, therefore, an advantage and objective of the present invention to provide improved weightlifting weight apparatuses.

Specifically, it is an advantage and objective of the present invention to provide improved weightlifting weight apparatuses that are easy to grip and manipulate by a user.

More specifically, it is an advantage and objective of the present invention to provide improved weightlifting weight apparatuses that allow a user to utilize the same easily for repetitive exercises.

Moreover, it is an advantage and objective of the present invention to provide improved weightlifting weight apparatuses that may more easily be utilized for both manual manipulation of the same and on weightlifting bars.

Specifically, it is an advantage and objective of the present invention to provide improved weightlifting weight apparatuses having manual hand grips and an aperture for disposing on a weightlifting bar.

Further, it is an advantage and objective of the present invention to provide improved weightlifting weight apparatuses that are precisely metered and have a variety of weights for use thereof by a user.

In addition, it is an advantage and objective of the present invention to provide improved weightlifting weight apparatuses that may easily be utilized on a user's head or neck.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to arcuate weightlifting weight apparatuses allowing a user to easily grip the same for a series of exercises. The arcuate weightlifting weight apparatuses provide gripping sections for holding the same with hands, base feet for placing on a floor and positioning in a vertical plane, and a neck or head pad for using the arcuate weightlifting weight on a user's neck or head with comfort. Moreover, the arcuate weightlifting weight apparatuses optionally include an aperture for placing on a weightlifting bar. Methods of using the same are further provided.

Figure 1A:
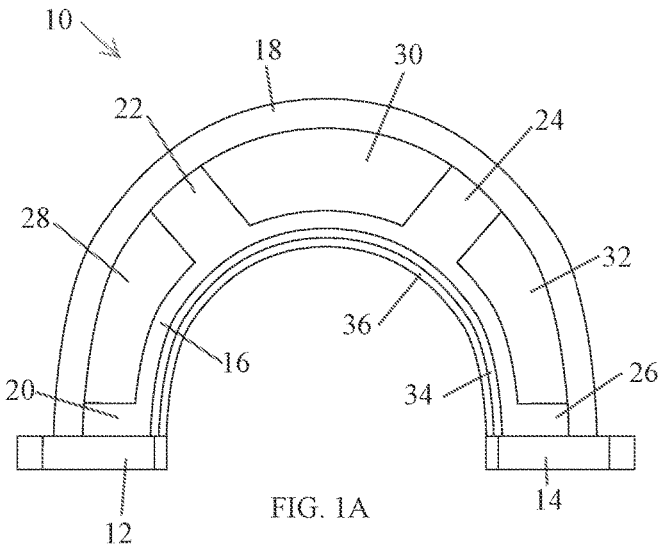
FIGS. 1A-1C illustrates a various views of an arcuate weightlifting weight apparatus in an embodiment of the present invention.
Figure 1B:
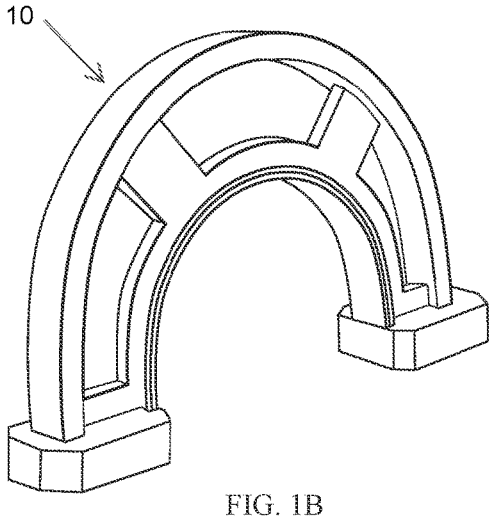
Figure 1C:
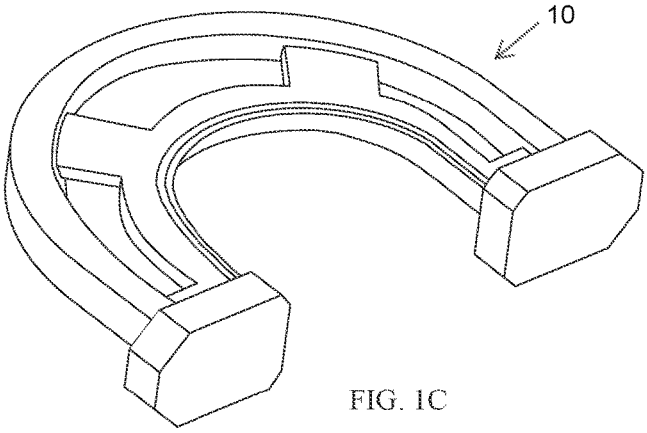

Now referring to the figures, FIGS. 1A-1C illustrate various views of a weightlifting weight apparatus 10 in an embodiment of the present invention. The weight apparatus 10 comprises, generally, an arcuate shape, and includes a first base plate 12 and a second base plate 14 spaced apart from each other, but generally coplanar so that each forms a foot for the weight apparatus 10. A first arcuate bridging member 16 may extend from the first base plate 12 to the second base plate 14 forming a first semi-circular element having a first radius. A second arcuate bridging member 18 may extend from the first base plate 12 to the second base plate 14 forming a second semi-circular element having a second radius. The first radius may be smaller than the second radius so that the first arcuate bridging member and the second arcuate bridging member are parallel.

Disposed between the first arcuate bridging member 16 and the second arcuate bridging member 18 may be reinforcement or connecting bar elements 20, 22, 24, 26, which may connect the first bridging member 16 to the second bridging member 18 and hold the two bridging members 16, 18 in spatial relationship with each other. Moreover, connecting bar element 20 may further be connected, such as welded, for example, to the first base plate 12 and the connecting bar element 26 may be connected, such as welded, for example, to the second base plate 14.

Based on the arrangement described above, the weight apparatus 10 may have a plurality of windows 28, 30, 32, thereby providing a plurality of gripping locations in various locations around the weight apparatus 10, such that a weightlifter can use his hands to manipulate the weight apparatus 10 in any number of repetitive exercises.

Disposed on an inside surface 34 of the first arcuate bridging member 16 may be a padded strip 36 that may extend over the length of the inside surface 34 of the first arcuate bridging member. The padded strip 36 may comprise a soft, preferably foam material. A user of the weight apparatus 10 may thus place the weight apparatus 10 on various body parts, such as his or her head or neck, and the padded strip 36 may make it comfortable to do so.

Figure 2A:
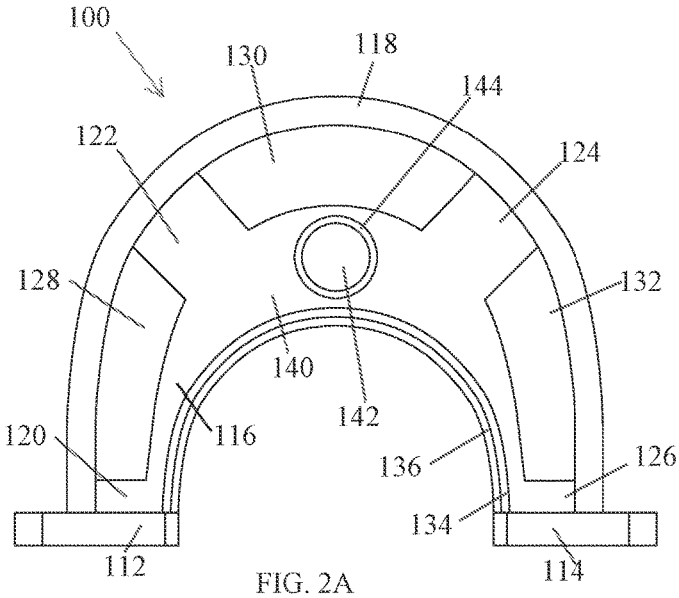
FIGS. 2A-2C illustrate various views of an arcuate weightlifting weight apparatus having an aperture for a weightlifting bar in an embodiment of the present invention.
Figure 2B:
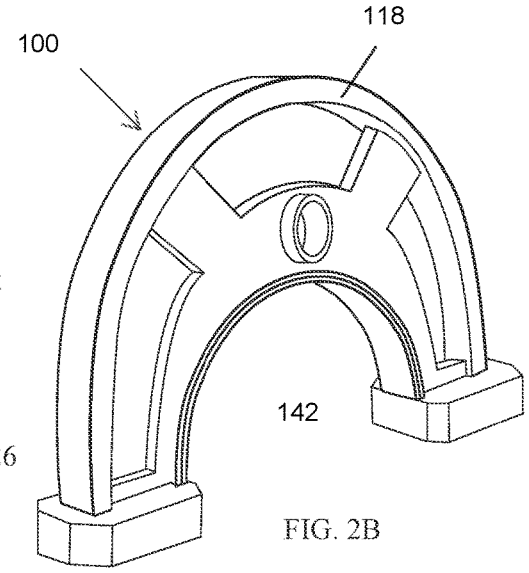
Figure 2C:
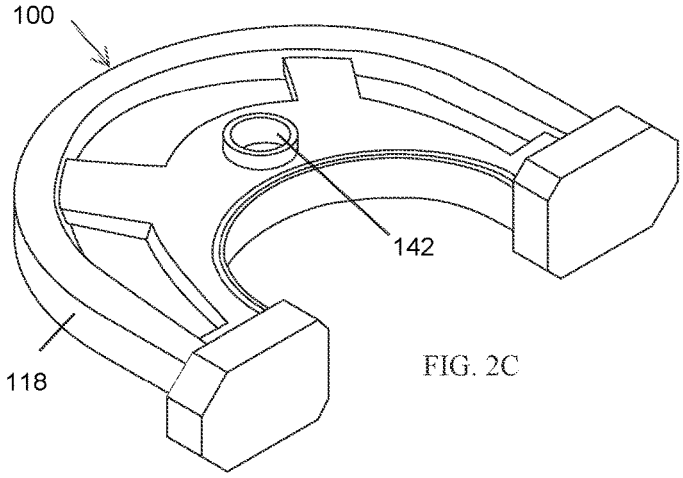

FIGS. 2A-2C illustrate various views of an alternate embodiment of the present invention, showing a weightlifting weight apparatus 100 having an arcuate shape, and including a first base plate 112 and a second base plate 114 spaced apart from each other, but generally coplanar so that each forms a foot for the weight apparatus 100. A first arcuate bridging member 116 may extend from the first base plate 112 to the second base plate 114 forming a first semi-circular element having a first radius. A second arcuate bridging member 118 may extend from the first base plate 112 to the second base plate 114 forming a second semi-circular element having a second radius. The first radius may be smaller than the second radius so that the first arcuate bridging member and the second arcuate bridging member are parallel.

Disposed between the first arcuate bridging member 116 and the second arcuate bridging member 118 may be reinforcement or connecting bar elements 120, 122, 124, 126, which may connect the first bridging member 116 to the second bridging member 118 and hold the two bridging members 116, 118 in spatial relationship with each other.

Moreover, connecting bar element 120 may further be connected, such as welded, for example, to the first base plate 112 and the connecting bar element 126 may be connected, such as welded, for example, to the second base plate 114.

Based on the arrangement described above, the weight apparatus 100 may have a plurality of windows 128, 130, 132, thereby providing a plurality of gripping locations in various locations around the weight apparatus 10, such that a weightlifter can use his hands to manipulate the weight apparatus 10 in any number of repetitive exercises.

Disposed on an inside surface 134 of the first arcuate bridging member 116 may be a padded strip 136 that may extend over the length of the inside surface 134 of the first arcuate bridging member 116. The padded strip 136 may comprise a soft material, preferably, for example, a foam material. A user of the weight apparatus 100 may thus place the weight apparatus 110 on various body parts, such as his or her head or neck, and the padded strip 136 may make it comfortable to do so.

Figure 3A:
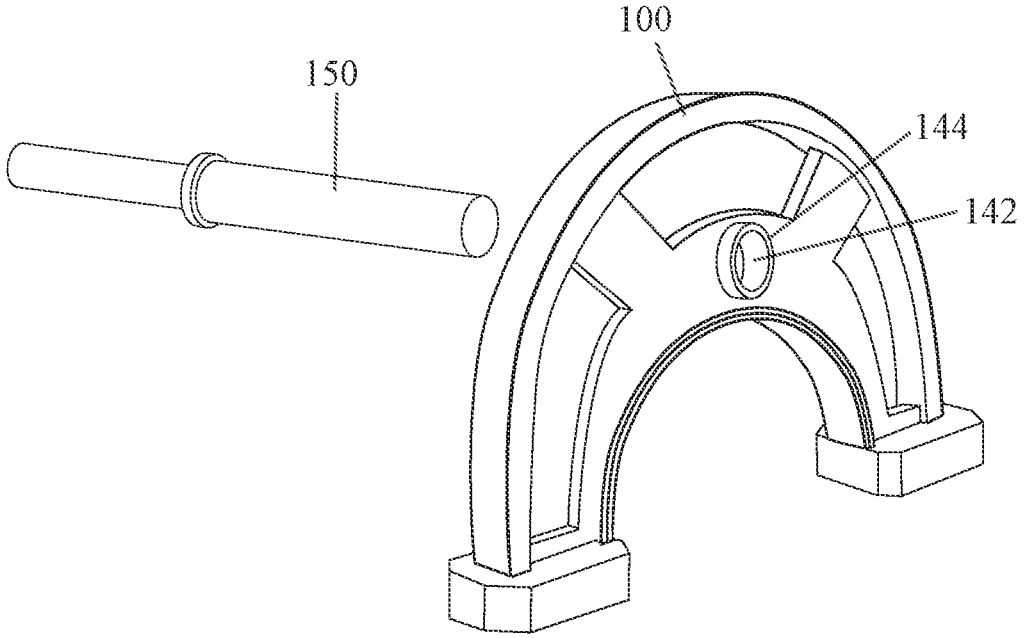
FIG. 3A-3B illustrate perspective views of an arcuate weightlifting weight apparatus having an aperture therein and showing a weightlifting bar disposed therethrough in an embodiment of the present invention.
Figure 3B:
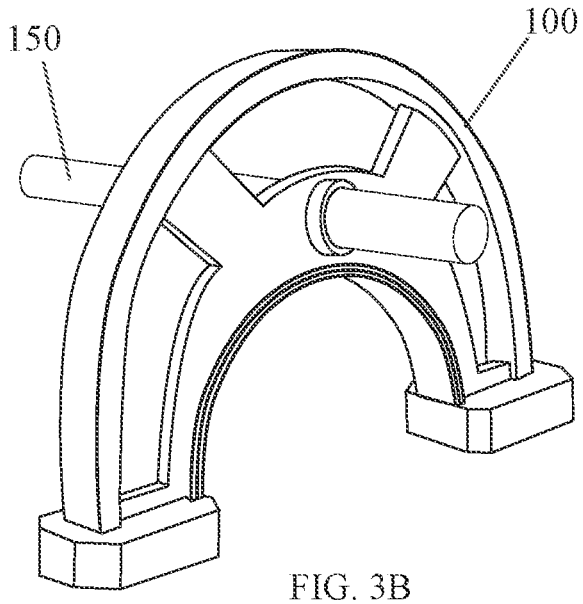

The first arcuate bridging member 116 may further have a wider area 140 allowing a weightlifting bar aperture 142, which may include a reinforcing tube 144 extending therethrough. A weightlifting bar 150, as illustrated in FIGS. 3A-3B, may be disposed through the reinforcing tube 144 through aperture 142. Placement of the weight apparatus 100 on the weightlifting bar 150 may allow one to easily use the same on the weightlifting bar to conduct exercises therewith. Typically, a first weight apparatus 100 may be disposed on one side of a weightlifting bar 150 and a second weight apparatus 100 of the same weight may be disposed on a second side of a weightlifting bar 150 so that the weights are generally balanced when a user is using the weightlifting bar.

Figure 4A:
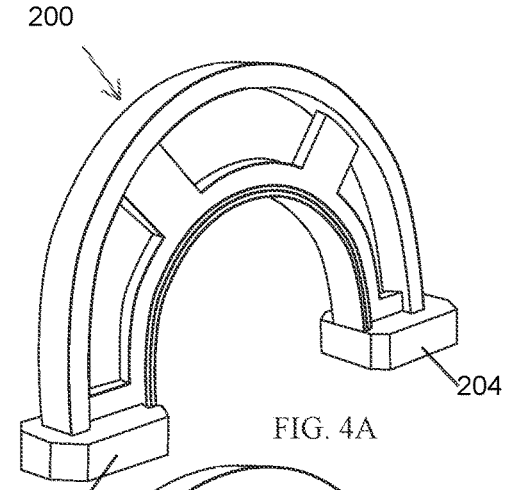
FIGS. 4A-4B illustrate views of an arcuate weightlifting weight apparatus of a specific metered weight in an embodiment of the present invention.
Figure 4B:
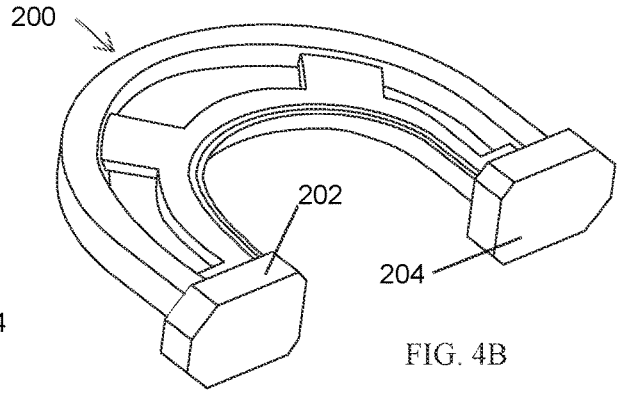
Figure 5A:
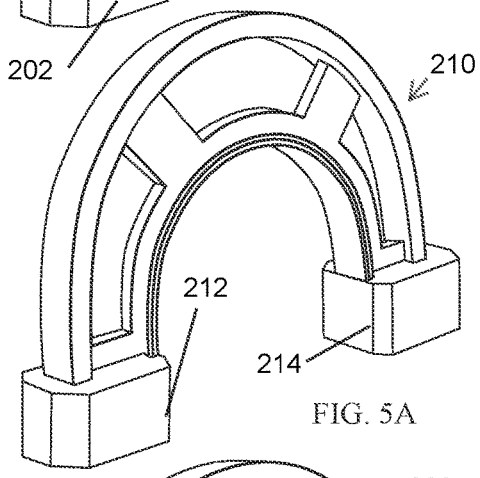
FIGS. 5A-5B illustrate views of an arcuate weightlifting weight apparatus of a specific metered weight in an embodiment of the present invention.
Figure 5B:
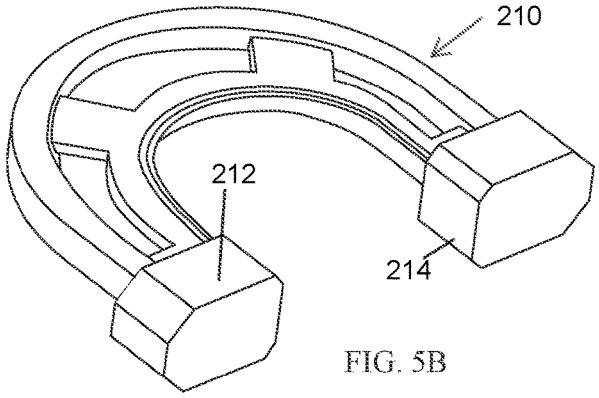
Figure 6A:
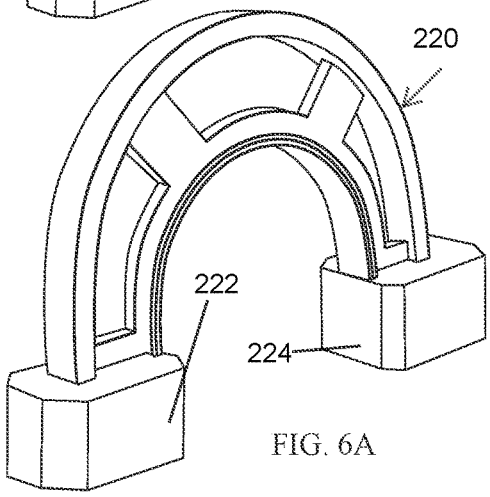
FIGS. 6A-6B illustrate views of an arcuate weightlifting weight apparatus of a specific metered weight in an embodiment of the present invention.
Figure 6B:
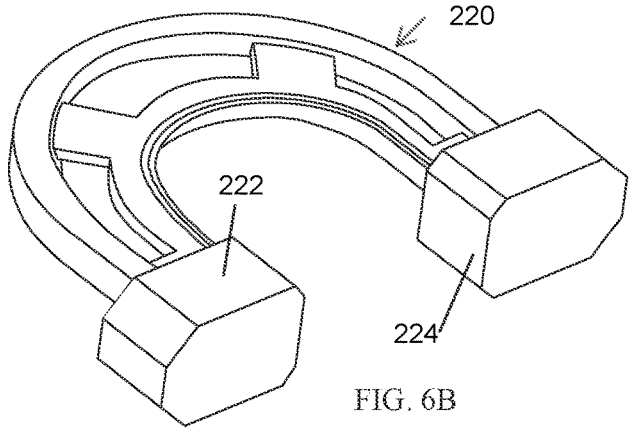

The weight apparatus 10 and the weight apparatus 100 may have a specific defined metered weight so that a user is cognizant of the amount of weight he or she is lifting. Different weightlifting weight apparatus may be heavier or lighter depending on the amount of material in each weightlifting weight apparatus. For example, FIGS. 4A-4B illustrate a weightlifting weight apparatus 200, which may be either embodiment shown in FIGS. 1A-1C and 2A-2C, having a metered weight of a known amount in first and second base plates 202, 204. FIGS. 5B-5B illustrate a weightlifting weight apparatus 210 having a metered weight of a larger amount in first and second base plates 212, 214 than shown in the apparatus 200 shown in FIGS. 4A-4B due to an increase in material in the base plates thereof. Likewise, FIGS. 6A-6B illustrate a weightlifting weight apparatus 10 having a metered weight of a larger amount in first and second base plates 222, 224 than shown in FIGS. 4A-4B and 5A-5B due to an increase in material in the base plates thereof. It should be noted that although FIGS. 4A, 4B, 5A, 5B, 6A-6B show various weightlifting weight apparatuses 10 having different weights in base plates thereof, the difference in weight may be due to less or more material in any other location of the apparatuses, and the present invention should not be limited as described and shown herein.

Figure 7A:
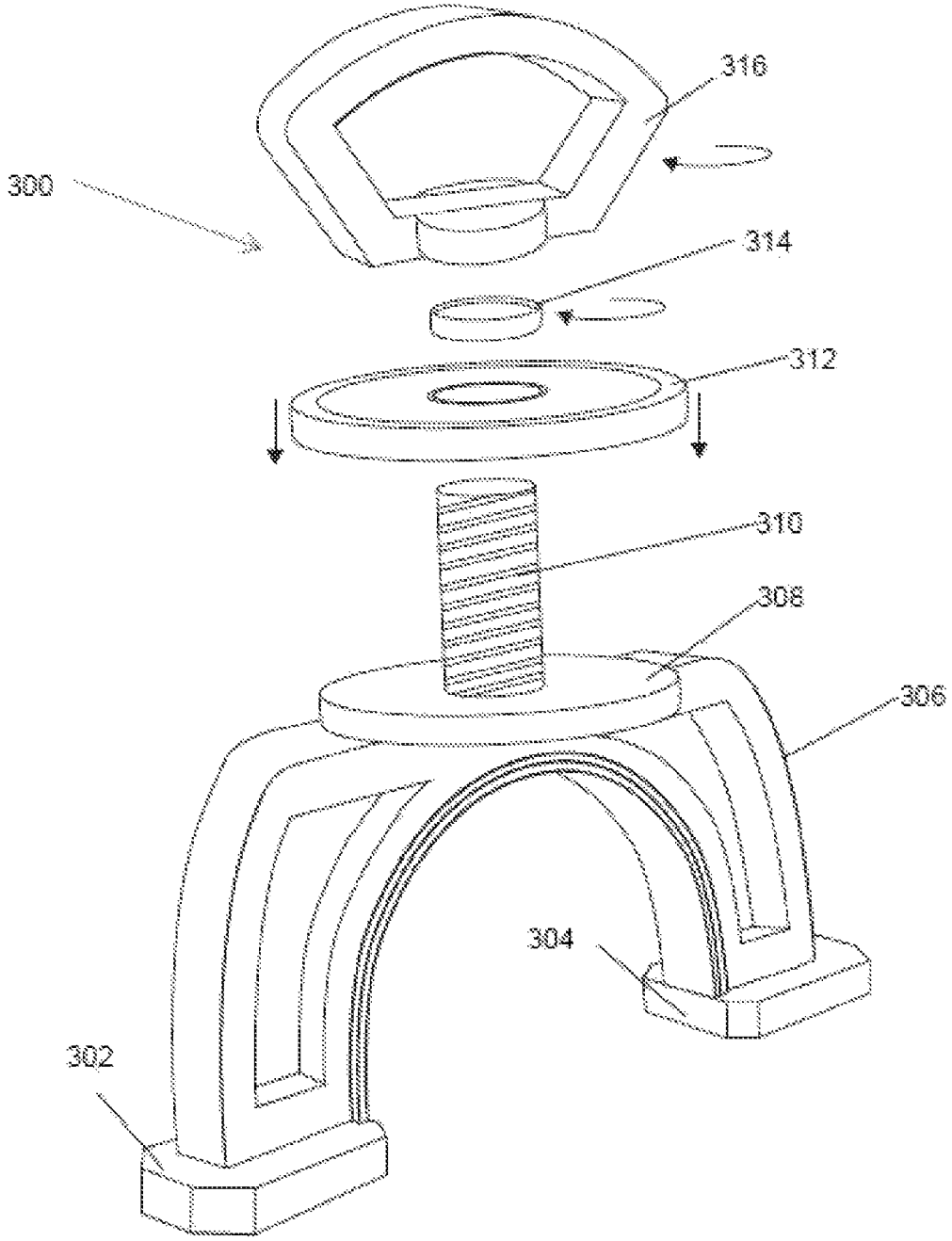
FIGS. 7A-7B illustrate an exploded perspective view and a perspective view, respectively, of an arcuate weightlifting weight apparatus having a bar for adding weights thereto in an embodiment of the present invention.
Figure 7B:
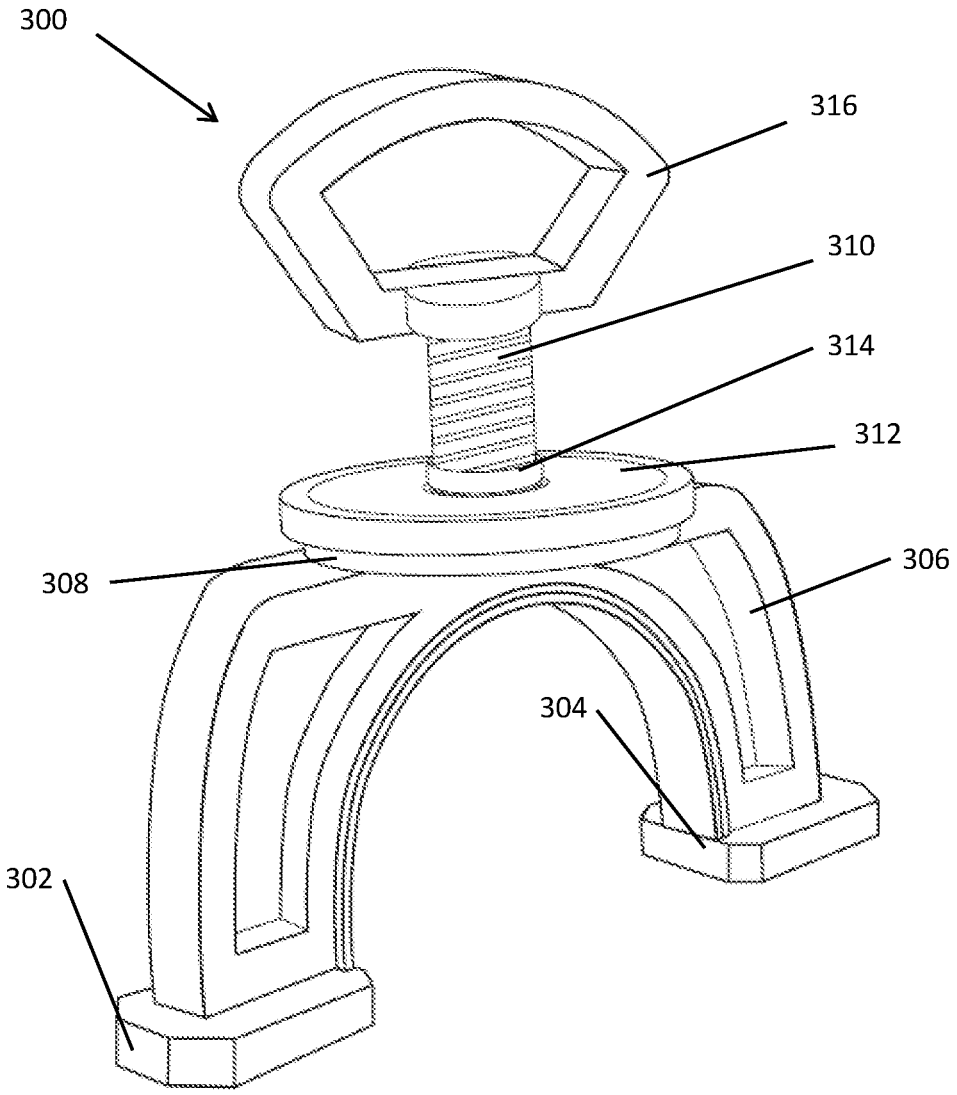

FIGS. 7A and 7B illustrate yet another embodiment of the present invention of an adjustable weight apparatus 300. Specifically, apparatus 300 may comprise first and second base plates 302, 304, generally as described above, and an arcuate bridging member 306 spanning between the first and second base plates 302, 304. A flat surface 308 may be disposed on a top of the arcuate bridging member 306 having a threaded rod 310 extended upwardly therefrom. The threaded rod 310 may allow for the placement of various items, such as, for example, one or more weight plates 312, a threaded locking collar 314, and a handle 316 that may be disposed on a top end of the threaded rod 310, as shown in FIG. 7B. Thus, different sized weight plates 312 may be placed on the threaded rod 310 to adjust the total weight of the apparatus 300, as desired. The threaded locking collar 314 may be added and threaded onto the threaded rod 310 on a top of the one or more weight plates 312, and the handle 316, having a threaded chamber may be threaded onto the threaded rod 310 thereby providing a way for a user to hold and/or grip the same. It should be noted that the rod 310 may be smooth and unthreaded and the collar 314 and the handle 316 may be held thereon in an alternate manner, as apparent to one of ordinary skill in the art.

Figure 8A:
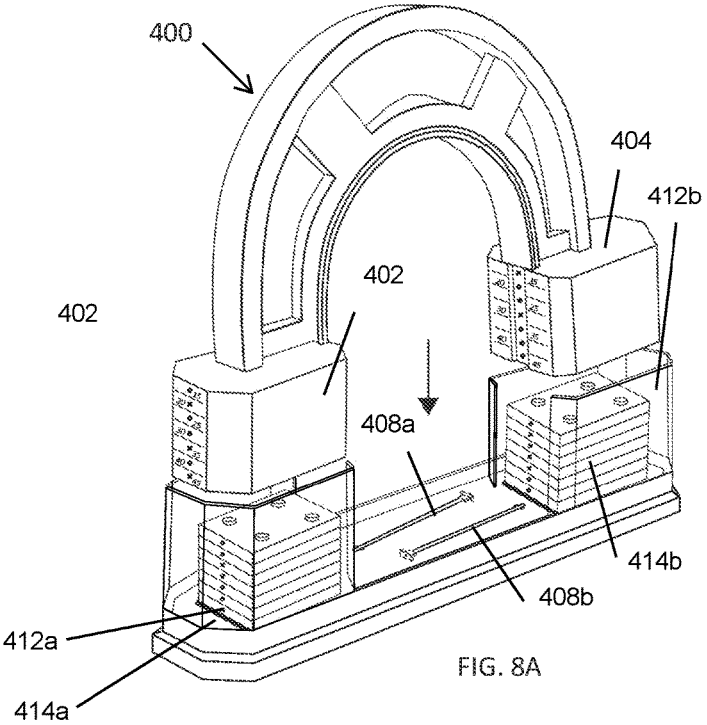
FIG. 8A-8B illustrate views of a weight adjustable weightlifting weight apparatus in an embodiment of the present invention.
Figure 8B:
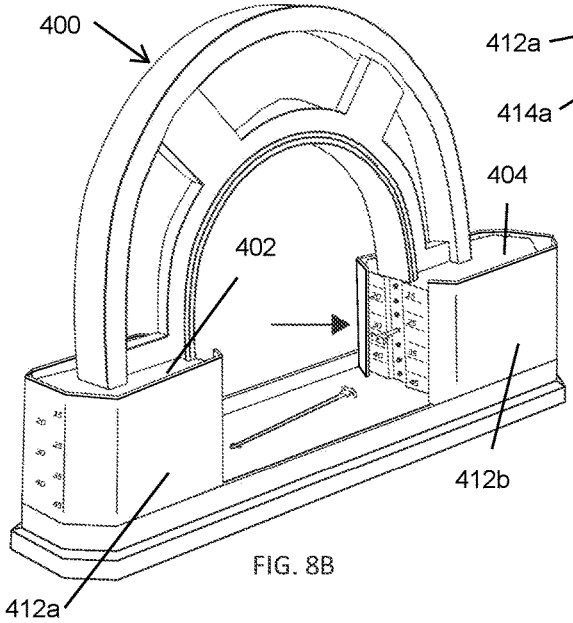

In an alternate embodiment of the present invention, FIGS. 8A-8B illustrate an adjustable weight apparatus 400 having first and second base plates 402, 404 and an arcuate bridging member 406 spanning between the first and second base plates 402, 404, having features generally described above with respect to the other embodiments. Each of the first and second base plates 402, 404 may have hollow interior chambers (not shown) that may allow one or more weight plates to be held therein using pins 408*a*, 408*b*. For example, the apparatus 400 may be placed on a base 410 having receptacles 412*a*, 412*b* having a stack of weight plates 414*a*, 414*b*, respectively.

As shown in FIG. 8B, the apparatus 400 may be pushed or disposed over the base 410 so that the interior chambers may be placed over the respective stacks of weight plates 414*a*, 414*b*. The pins 408*a*, 408*b* may be placed through apertures that may be disposed within each of the base plates 402, 404, respectively, which may hold the stack of weight plates 414*a*, 414*b* or portions thereof, respectively, within the respective interior chambers of the base plates 402, 404. Each of the weight plates in the stacks of weight plates 414*a*, 414*b* may have apertures therein that may match with the apertures on the first and second base plates 402, 404, respectively. Thus, a user may select specific metered amounts of weights to be held within the interior chambers of the first and second base plates 402, 404 of the apparatus 400 as desired.

Figure 9A:
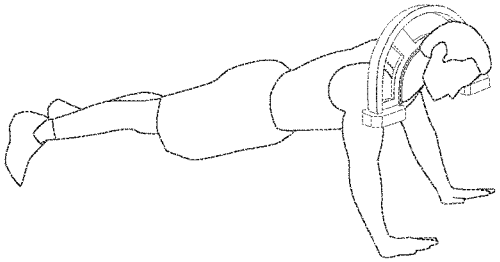
FIGS. 9A-9P illustrates exemplary exercises a user may perform using a weightlifting weight apparatus of the present invention in embodiments of the present invention.
Figure 9B:
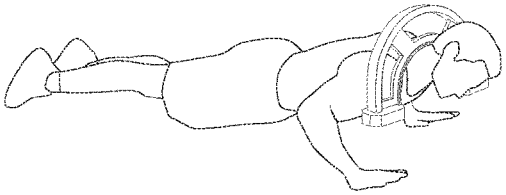
Figure 9C:
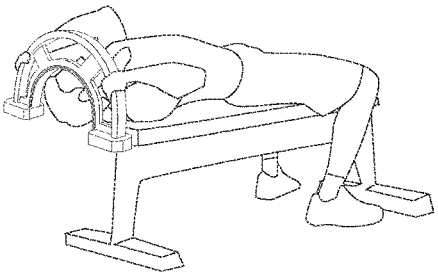
Figure 9D:
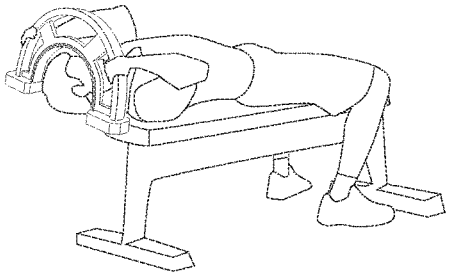
Figure 9E:
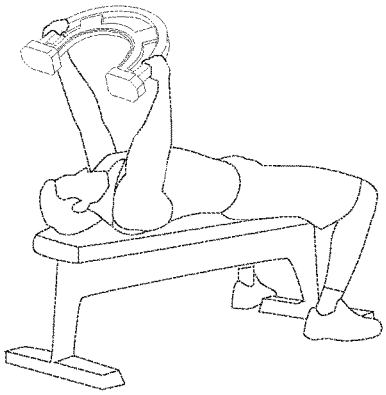
Figure 9F:
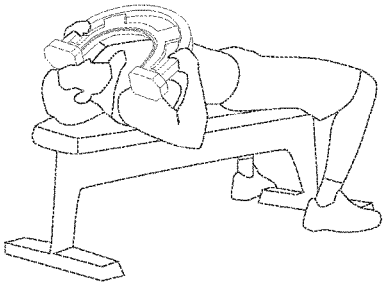
Figure 9G:
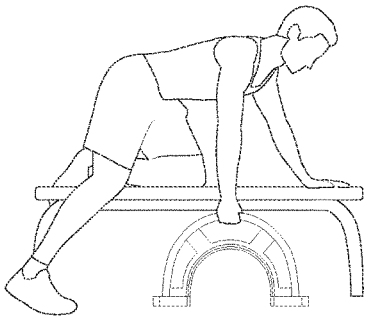
Figure 9H:
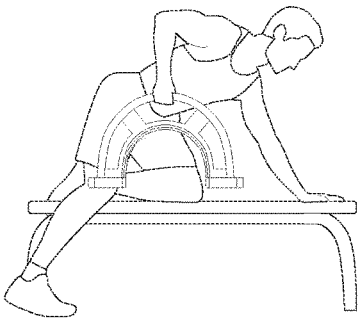
Figure 9I:
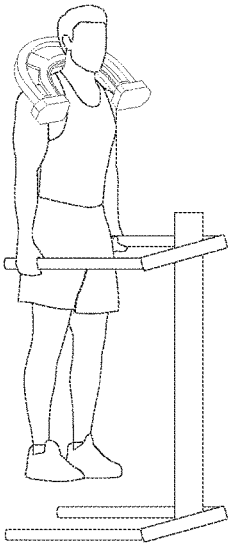
Figure 9J:
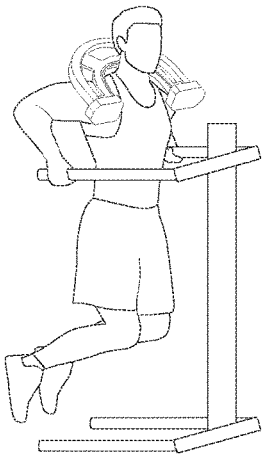
Figure 9K:
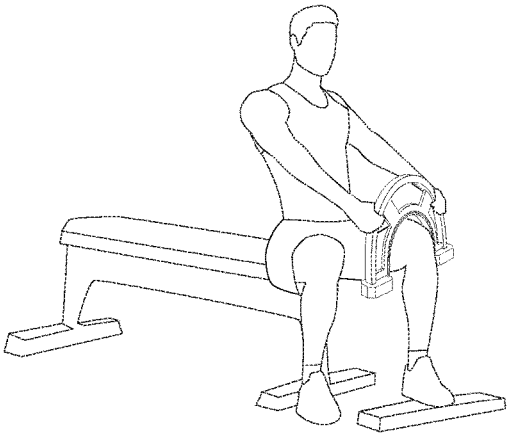
Figure 9L:
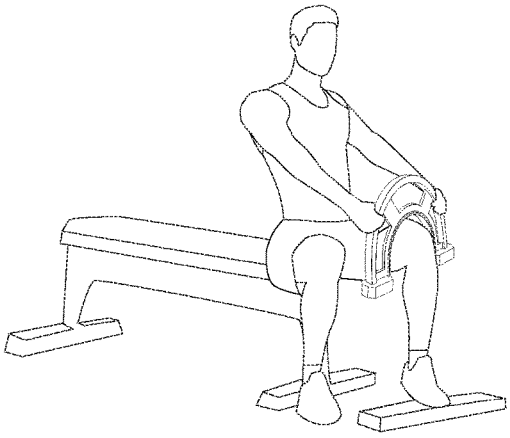
Figure 9M:
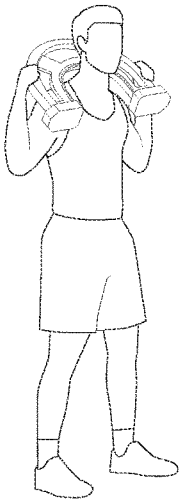
Figure 9N:
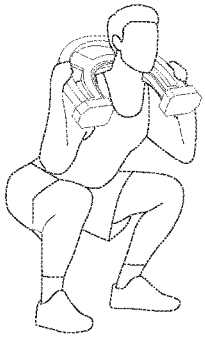
Figure 9O:
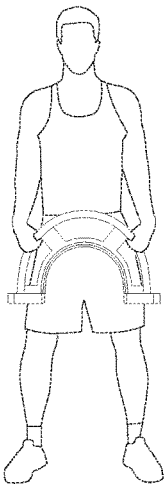
Figure 9P:
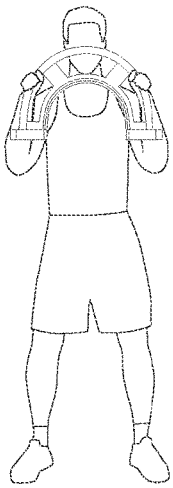

In use, a user may utilize a single weightlifting weight apparatus 10, 100, 200, 300, or 400, as described herein, to conduct exercises therewith, with the user grasping the weightlifting weight apparatuses in various locations and/or placing the weightlifting weight apparatuses on his or her head or neck or other body part. Alternatively, two weightlifting weight apparatuses of the present invention of the same or different weight amount may be utilized to conduct exercises, or for use on a weight-lifting bar, as described above with respect to weightlifting weight apparatus 100. Specifically, FIGS. 9A to 9P illustrate various exercises one may do using one or more of the weightlifting weight apparatuses of the present invention. Specifically, the various gripping locations may be grasped by a user to conduct the exercises. Although specific exercises are illustrated in FIGS. 9A-9P using the weightlifting weight apparatuses of the present invention, any number of exercises may be performed and the present invention should not be limited as described and shown herein.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

What is claimed is:

1. A weightlifting weight apparatus comprising:

a first flat base plate;

a second flat base plate, wherein the first flat base plate is coplanar with the second flat base plate;

a first arcuate bridging member extending between the first flat base plate and the second flat base plate and a space between the first flat base plate and the second flat base plate; and a pad on an exposed surface of the first arcuate bridging member, wherein the first flat base plate comprises a first metered weight, the second flat base plate comprises a second metered weight, and the first arcuate bridging member comprises a third metered weight so that the weightlifting weight apparatus comprises a fourth metered weight that is a combination of the first metered weight, the second metered weight, and the third metered weight.

2. The weightlifting weight apparatus of claim 1 further comprising:

a second arcuate bridging member extending between the first flat base and the second flat base;

at least one reinforcement element extending between the first arcuate bridging member and the second arcuate bridging member connecting the first arcuate bridging member to the second arcuate bridging member.

3. The weightlifting weight apparatus of claim 2 further comprising:

an aperture disposed within the at least one reinforcement element extending between the first arcuate bridging member and the second arcuate bridging member, wherein the aperture is configured to hold a weightlifting bar.

4. The weightlifting weight apparatus of claim 1 wherein the pad is a foam material.

5. The weightlifting weight apparatus of claim 1 further comprising:

an aperture disposed within the first arcuate bridging member wherein the aperture is configured to hold a weightlifting bar.

6. The weightlifting weight apparatus of claim 1 further comprising:

a handle disposed within the first arcuate bridging member configured to allow a user to hold the apparatus.

7. The weightlifting weight apparatus of claim 1 further comprising: a mechanism configured to allow a user to adjust the weight of the apparatus.

8. The weightlifting weight apparatus of claim 7 wherein the mechanism comprises a flat portion having a rod extending therefrom, wherein the rod is configured to hold one or more removable weight plates on the flat portion.

9. The weightlifting weight apparatus of claim 8 wherein the rod is threaded.

10. The weightlifting weight apparatus of claim 8 further comprising: a collar configured to be disposed over the rod, wherein the collar is further configured to lock the one or more removable weight plates onto the rod and the flat portion.

11. The weightlifting weight apparatus of claim 10 wherein the rod is threaded and further wherein the collar comprises threads on an interior surface that mate with threads on the rod.

12. The weightlifting weight apparatus of claim 8 further comprising:

a handle configured to removably attach to a terminal end of the rod.

13. The weightlifting weight apparatus of claim 12 wherein the rod is threaded and further wherein the handle comprises threads on an interior surface that mate with threads on the rod.

14. The weightlifting weight apparatus of claim 1 wherein the first base plate has a first interior chamber and further wherein the first base plate comprises a first aperture on a side thereof.

15. The weightlifting weight apparatus of claim 14 further comprising:

a first weight plate having a second aperture therein, wherein the first aperture on the side of the first base plate aligns with the second aperture in the first weight plate when the first weight plate is disposed within the first interior chamber of the first base plate.

16. The weightlifting weight apparatus of claim 15 further comprising:

a first pin configured to be disposed through the first and second apertures thereby holding the first weight plate within the interior chamber of the first base plate.

17. The weightlifting weight apparatus of claim 15 wherein the first plate further comprises a third aperture on the side thereof.

18. The weightlifting apparatus of claim 17 further comprising:

a second weight plate having a fourth aperture therein, wherein the second aperture on the side of the first base plate aligns with the fourth aperture in the second weight plate when both the first weight plate and the second weight plate are disposed within the first interior chamber of the first base plate.

19. The weightlifting weight apparatus of claim 14 wherein the second base plate has a second hollow interior chamber configured to receive a second weight plate.

20. The weightlifting weight apparatus of claim 14 further comprising:

a base having a receptacle configured to hold the first weight plate, wherein the first base plate is configured to be disposed within the receptacle causing the first weight plate to be disposed within the interior chamber of the first base plate.

21. A weightlifting weight apparatus comprising:

a first flat base plate;

a second flat base plate;

a first arcuate bridging member extending between the first flat base plate and the second flat base plate;

a pad on an exposed surface of the first arcuate bridging member, a second arcuate bridging member extending between the first flat base and the second flat base;

at least one reinforcement element extending between the first arcuate bridging member and the second arcuate bridging member connecting the first arcuate bridging member to the second arcuate bridging member; and an aperture disposed within the at least one reinforcement element extending between the first arcuate bridging member and the second arcuate bridging member, wherein the aperture is configured to hold a weightlifting bar.

* * * * *